US006238770B1

(12) United States Patent
Moul

(10) Patent No.: US 6,238,770 B1
(45) Date of Patent: May 29, 2001

(54) TIER SHEET FOR LAYERED AND STACKED PACKAGING

(75) Inventor: Joel L. Moul, Rockford, MI (US)

(73) Assignee: Plastic Tier Sheet, Inc., Grand Rapids, MI (US)

( * ) Notice: Subject to any disclaimer, the term of this patent is extended or adjusted under 35 U.S.C. 154(b) by 0 days.

(21) Appl. No.: 09/318,999

(22) Filed: May 26, 1999

(51) Int. Cl.[7] ..... B32B 3/04

(52) U.S. Cl. ..... 428/124; 428/126; 428/155; 428/181

(58) Field of Search ..... 428/121, 124, 428/126, 127, 128, 167, 155, 181, 192; 206/395, 386, 494

(56) References Cited

U.S. PATENT DOCUMENTS

| | | | |
|---|---|---|---|
| D. 237,468 | 11/1975 | Andrews et al. . | |
| D. 305,738 | 1/1990 | Day . | |
| 2,120,610 | 6/1938 | Howard . | |
| 2,448,679 | 9/1948 | Meinhardt . | |
| 2,620,117 | 12/1952 | Nemoede . | |
| 2,928,200 | 3/1960 | Shiels . | |
| 3,698,677 | 10/1972 | Looker . | |
| 3,769,747 | 11/1973 | Chapman, Jr. . | |
| 3,776,145 | 12/1973 | Anderson et al. . | |
| 4,042,127 | 8/1977 | Brossia . | |
| 4,044,501 | 8/1977 | Frydryk . | |
| 4,142,634 | 3/1979 | Leff et al. . | |
| 4,226,192 | 10/1980 | Myers . | |
| 4,502,597 | 3/1985 | Cantey . | |
| 4,507,348 | 3/1985 | Nagata et al. . | |
| 4,615,443 | 10/1986 | Deffner et al. . | |
| 4,653,651 | 3/1987 | Flum . | |
| 4,735,321 | 4/1988 | Day . | |
| 4,744,465 | 5/1988 | Parker . | |
| 4,834,243 | 5/1989 | Langenbeck . | |
| 5,038,961 | 8/1991 | Watanabe et al. . | |
| 5,080,960 | 1/1992 | Smorada . | |
| 5,269,645 | 12/1993 | Winski . | |
| 5,330,050 | 7/1994 | Stansbury, Jr. et al. . | |
| 5,339,957 | 8/1994 | Carstens . | |
| 5,360,112 | 11/1994 | Beauchamp . | |
| 5,401,563 * | 3/1995 | Kurata et al. | 428/212 |
| 5,473,995 | 12/1995 | Gottlieb . | |
| 5,547,081 | 8/1996 | Mullock et al. . | |

* cited by examiner

*Primary Examiner*—Donald J. Loney
(74) *Attorney, Agent, or Firm*—Price Heneveld Cooper Dewitt & Litton

(57) ABSTRACT

A plastic tier sheet is provided for use in layered and stacked arrangements of bottles and similar packages to assist in shipping and handling the bottles and similar packages. The plastic tier sheet includes a center panel and edge flanges extending along edges of the center panel and connected to the center panel by living hinges formed by scoring the plastic sheet along its edges. The edge flanges are bonded to the center panel using the material of the tier sheet, such as by sonic spot welding. The edge flanges are secured tight against the center panel, such that there are no gaps to collect debris or unsanitary manner, but the sonic welded spots are spaced apart to minimize the number of spots required. The plastic tier sheet is characteristically formed without use of separate bonding materials or fasteners, such that there is low risk of parts or pieces falling into the bottles and similar packages being transported. The plastic tier sheet is made of polypropylene homopolymer, such that it has long life. A method of forming the plastic tier sheet is also shown and claimed.

15 Claims, 2 Drawing Sheets

TIER SHEET FOR LAYERED AND STACKED PACKAGING

BACKGROUND OF THE INVENTION

The present invention relates to tier sheets used to separate a layered and stacked arrangement of packages to be shipped, such as layers of soda bottles or canned goods, and also relates to methods of manufacturing such tier sheets.

Bottling companies and other companies in the food industry often ship products in multiple layers on pallets, with each layer separated by a tier sheet that adds stability to the stack. At least in the bottling industry, cardboard is used because it is low cost and lightweight, and further it is easily disposed of. However, cardboard suffers from short life, such that it must be thrown away after only a limited number of cycles of use, such as about five-trip cycles. Further, cardboard can generate dust as edges of the cardboard become worn. Further, the edges of cardboard can collect debris and unsanitary particles or provide a place for insects to hide. Also, cardboard is sensitive to water and moisture, both in terms of degrading strength of the cardboard and also in terms of the cardboard soaking up the water and holding it while molds and germs grow.

Cardboard tier sheets commonly include folded edges that are glued in place to form a lipped edge that helps retain individual packages on the tier sheets. However, the glue adds expense to the tier sheet, and further glue is a separate material that requires separate application to the cardboard, as well as time to dry. Also, the glue can break off, adding to the debris. Still further, unless the glue is continuously applied along the edges, the edges may form gaps, which gaps can collect debris, unsanitary materials, and insects.

Accordingly, a tier sheet solving the aforementioned problems and having the aforementioned advantages is desired.

SUMMARY OF THE PRESENT INVENTION

In one aspect of the present invention, a plastic tier sheet is provided for use in layered and stacked arrangements of bottles and similar packages to assist in shipping and handling the bottles and similar packages. The plastic tier sheet includes a tier sheet made from a plastic sheet with linear edges and score lines spaced from but parallel the linear edges. The score lines divide the plastic sheet into a center panel and edge flanges around the center panel, and are deep enough into the plastic sheet to allow the edge flanges to uniformly fold, but to leave material forming integral hinges connecting the edge flanges to the center panel. The edge flanges are folded back onto the center panel and include material of the edge flanges bonded to material of the center panel. The edge flanges characteristically lie flat against the center panel. Thus, there are substantially no gaps between the edge flanges and the center panel, thus minimizing collection of debris, unsanitary matter, and insects.

In another aspect of the present invention, a method of manufacturing plastic tier sheets is provided for use in layered and stacked arrangements of bottles and similar packages to assist in shipping and handling. The method comprises steps of providing a flat plastic sheet with linear edges, the plastic sheet having a stiffness sufficient to act as a separator to separate layers of packaged materials and to stabilize a stack of such layers. The method further includes scoring lines into the plastic sheet at locations spaced from but parallel the linear edges, the score lines dividing the plastic sheet into a center panel and edge flanges around the center panel, with the score lines being relatively deep into the plastic sheet, but leaving material forming integral hinges connecting the edge flanges to the center panel. The method still further includes folding the edge flanges back onto the center panel and bonding the edge flanges to the center panel, with the edge flanges characteristically lying flat against the center panel to form a tier sheet with substantially no gaps between the edge flanges and the center panel.

In yet another aspect of the present invention, a method includes steps of providing a plastic sheet having edges forming a rectangular perimeter, notching corners in the sheet, and forming the sheet parallel the edges of the sheet to form integral hinges and edge flanges connected to a center panel of the sheet by the integral hinges. The method further includes folding the edge flanges against the center panel and bonding the edge flanges to the center panel. In a narrower form, the step of forming includes scoring the sheet along the edge flanges to form the integral hinges.

These and other features, objects, and advantages of the present invention will become apparent to a person of ordinary skill upon reading the following description and claims together with reference to the accompanying drawings.

DETAILED DESCRIPTION OF THE PREFERRED EMBODIMENT

Figure 1:
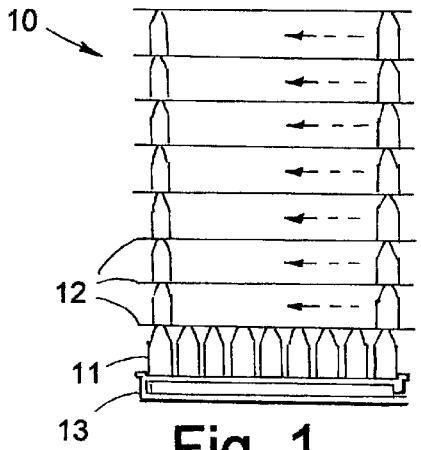
FIG. 1 is side view of a stacked arrangement using a plurality of tier sheets of the present invention.

A layered and stacked arrangement 10 (FIG. 1) includes layers of bottles 11 or similar packages separated by tier sheets 12 and supported on a pallet 13. The tier sheets 12 assist in shipping the bottles 11 by stabilizing the layered and stacked arrangement 10. The tier sheet 12 comprises a polymeric sheet that includes a center panel 14 and edge flanges 15 that extend along edges of the center panel 14. The edge flanges 15 form a lip that helps retain the bottles 11 on the tier sheet 12 when in the layered and stacked arrangement 10. The tier sheet 12 is particularly durable and long lasting, yet sanitary and washable, such that the tier sheet 12 results in an improved layered and stacked arrangement, as well as reduced overall cost, over time as the product is reusable.

Figure 2:
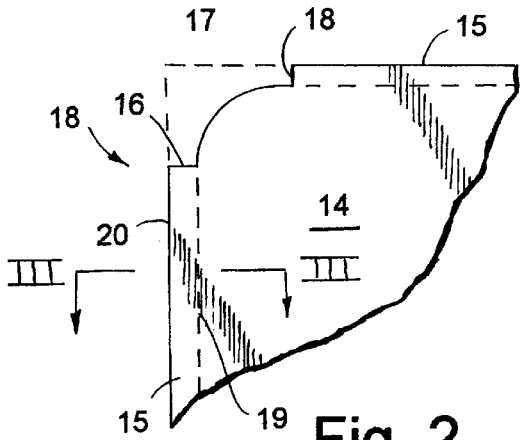
FIG. 2 is a fragmentary corner section of the blank for making the tier sheet after notching a corner of the blank.
Figure 4:
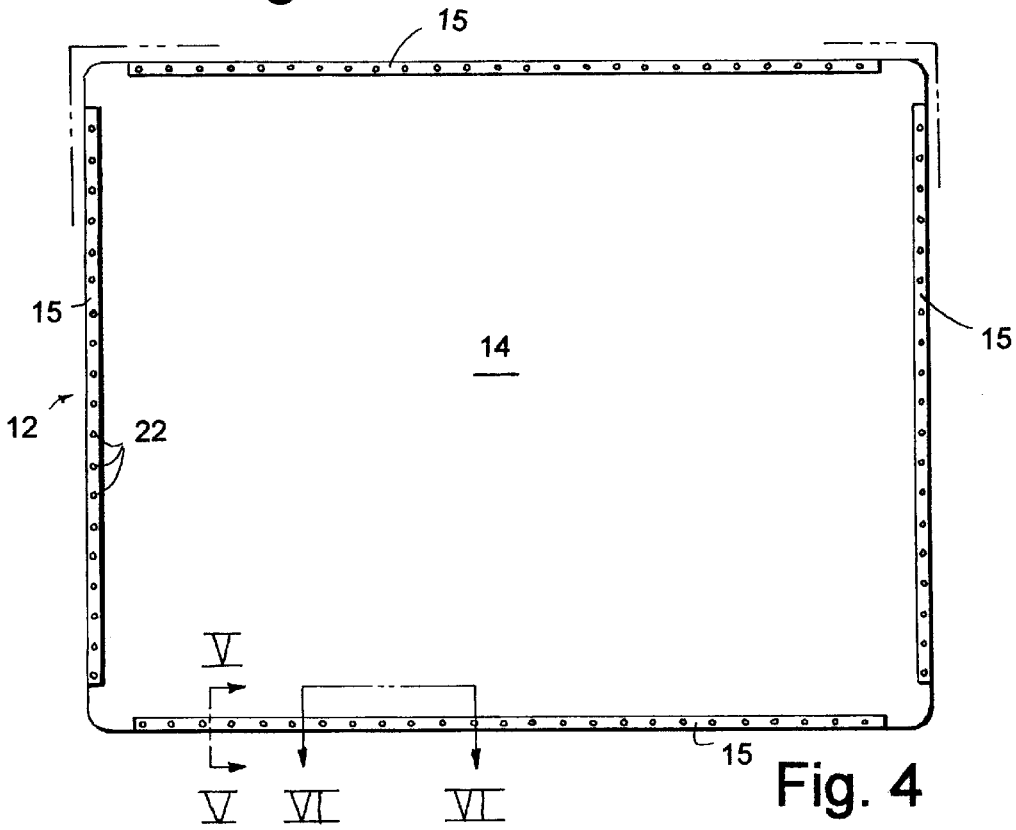
FIG. 4 is a plan view of the plastic tier sheet shown in FIG. 1.
Figure 3:
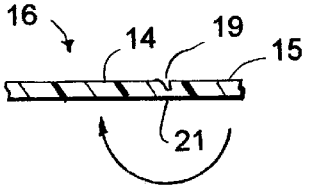
FIG. 3 is a cross-sectional view taken along the line III—III in FIG. 2.
Figure 5:
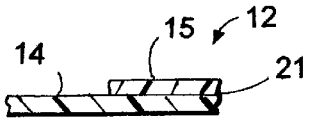
FIG. 5 is a cross section taken along the line V—V in FIG. 4.
Figure 6:
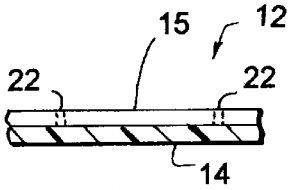
FIG. 6 is a cross section taken along the line VI—VI in FIG. 4.

To construct tier sheet 12, a flat blank 16 (FIG. 2) of a suitable polymeric material, such as polypropylene homopolymer, is provided having a thickness of about 0.055 inches (0.0045 inches) and having a suitable width and depth. The blank 16 is characteristically flat, having an amplitude of less than 0.125 inches when measured in a free state on a flat surface. As described below, in a first step, corners of the blank 16 are notched to form a radiused cut 17 and linear cuts 18. Simultaneously, a score or crease 19 is cut along the edges 20 of the center panel 14 to form edge flanges 15 that are optimally about 0.7 inches to about 0.8 inches wide. The slit 19 extends about 80 percent to 90 percent (preferably 90 percent) into the blank 16, with the remaining material forming a living hinge 21 (FIG. 3) connecting the edge flanges 15 to edges of the center panel 14. The edge flanges 15 are folded back onto the center panel 14 of the blank 16, and then sonically spot welded to the center panel 14 at locations 22 (FIG. 6). The weld locations 22 are optimally about two inches apart, but different spacing can be used as long as the weld locations 22 are close enough together to closely hold the edge flanges 15 against the center panel 14 without gapping occurring under the edge flanges 15. Notably, it is contemplated that the edge flanges 15 can be bonded to the center panel 14 in different ways, such as by continuous sonic welding, thermal bonding techniques, mechanical vibrational techniques, RF welding techniques, chemical bonding techniques (including solvent bonding techniques), hot melt gluing, and the like. It is preferable that the bonding occur without the addition of separate adhesive material, so that the material of the blank 16 forms the entire tier sheet 12. Further, the above listed attachment techniques do not have a "cure" time or at least have a very short stabilization time. The resulting tier sheet 12 is very sanitary because the plastic sheet is very clean and does not tend to attract debris or insects, nor does the tier sheet 12 tend to create debris or dust as it wears. Also, the tier sheet 12 is washable and sanitizable, such that it can be easily cleaned. Still further, the material is long lasting and does not tend to degrade with moisture or hold water. It is contemplated that the tier sheets 12 can last 200+ shipping cycles, depending upon the care and physical abuse that they receive when in use. This is believed to be about forty times longer than the expected life of cardboard tier sheets.

Figure 7:
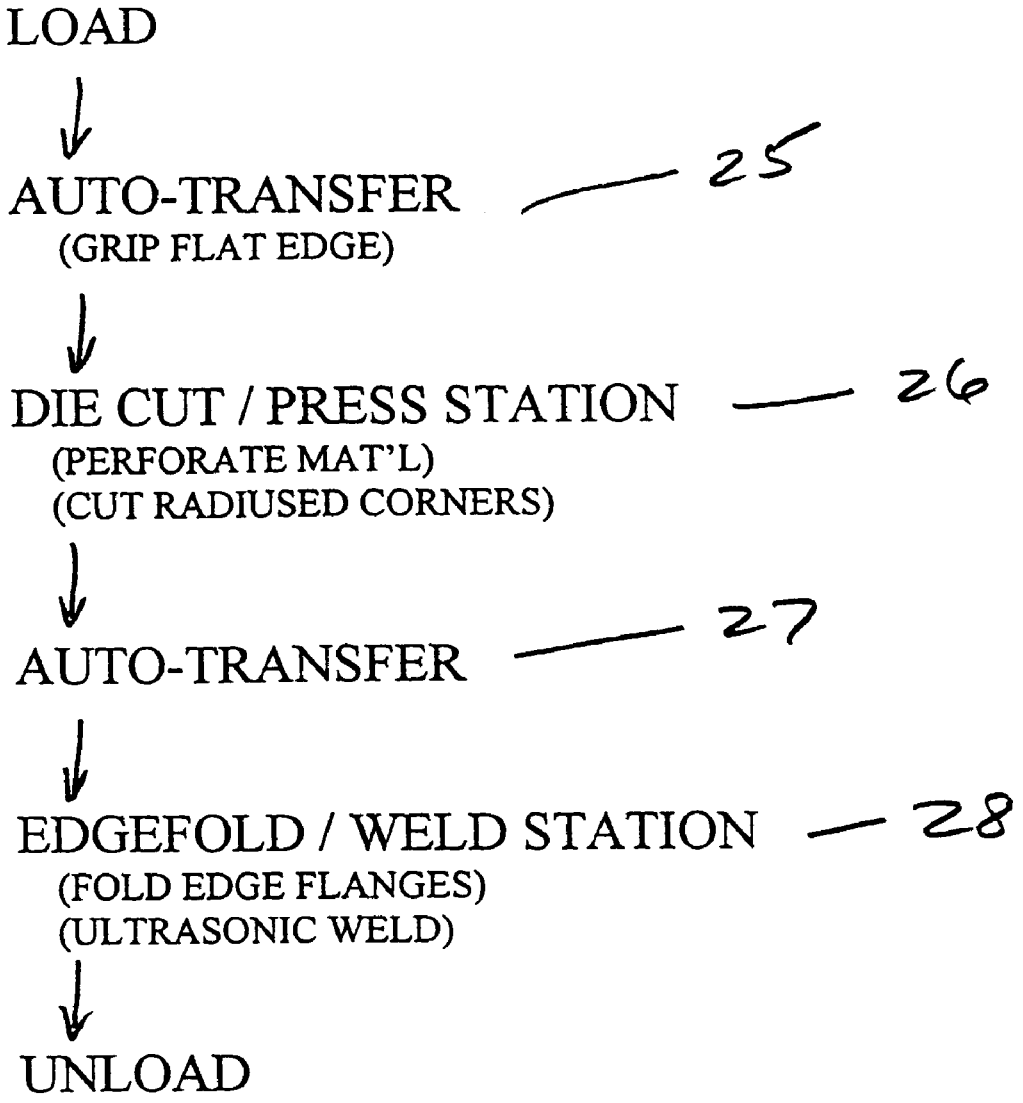
FIG. 7 is a flow diagram illustrating the method of the present invention.

It is contemplated that different operations and sequences can be used to manufacture the present tier sheet 12. However the operations, sequence, and system described below is particularly efficient and cost effective in producing plastic tier sheets. Blanks for the tier sheet forming process are automatically loaded from two or more directions, which allows the operator to refill one of the supply stations while blanks are being taken from the other station. The sheets are automatically transferred from the load station into the die-cut press station in a step 25 with grip action applied to a leading edge of a blank 16 (FIG. 7). A press platen carrying a die cutter automatically extends into engagement with the blank 16 in step 26 to perforate the material to form scores 19 and to cut the corners to the required shape, including the radiused cuts 17 and the linear cuts 18. The press platen retracts and the partially formed blank 16 is then transferred to the next station in step 27. In the edgefold-and-weld station of step 28, the perforated sides are automatically edgefolded, such that the edge flanges 15 are folded around the living hinge 21 flat against the center panel 14. This step achieves the overall length and width dimensions required of the tier sheet 12. Then ultrasonic welders are cycled, including descending, welding, holding, and thereafter retracting the welder heads and welder tools. When the edgefold blades retract, the sheet is automatically transferred to the unload station. An automatic transfer unloads a fully formed tier sheet 12 onto a skid located in one of two locations for unloading.

In the foregoing description, it will be readily appreciated by persons skilled in the art that modifications may be made to the invention without departing from the concepts disclosed herein. Such modifications are to be considered as included in the following claims, unless these claims by their language expressly state otherwise.

The invention claimed is:

1. A plastic tier sheet for use in layered and stacked arrangements of bottles and similar packages to assist in shipping and handling the bottles and similar packages, comprising:

a tier sheet made from a plastic sheet with linear edges and score lines spaced from but parallel the linear edges, the score lines dividing the plastic sheet into a center panel and edge flanges around the center panel, the score lines being deep into the plastic sheet to allow the edge flanges to uniformly fold, but leaving material forming integral hinges connecting the edge flanges to the center panel, the edge flanges being folded back onto the center panel and including material of the edge flanges bonded to material of the center panel, with the edge flanges characteristically lying flat against the center panel, such that there are substantially no gaps between the edge flanges and the center panel, thus minimizing collection of debris, unsanitary matter, and insects.

2. The plastic tier sheet defined in claim 1, wherein the score lines extend into the material to at least about 80 percent of a thickness of the plastic sheet.

3. The plastic tier sheet defined in claim 2, wherein the thickness of the plastic sheet is less than 0.06 inches.

4. The plastic tier sheet defined in claim 3, wherein the material of the plastic sheet is polypropylene homopolymer.

5. The plastic tier sheet defined in claim 2, wherein a width of the edge flanges is less than about 0.82 inches.

6. The plastic tier sheet defined in claim 3, wherein a thickness of the sheet is about 0.055 inches.

7. The plastic tier sheet defined in claim 6, wherein the edge flanges and the center panel include welded material that bonds directly together without the addition of additional bonding material.

8. The plastic tier sheet defined in claim 7, wherein the welded material is characteristically the only material bonding the edge flanges to the center panel.

9. The plastic tier sheet defined in claim 8, wherein the welded material is integrally bonded together at spot locations spaced about two inches apart.

10. The plastic tier sheet defined in claim 1, wherein the material of the plastic sheet forms the entire plastic tier sheet and characteristically there is an absence of any additional material forming a part of the plastic tier sheet.

11. The plastic tier sheet defined in claim 1, including trimmed corners that separate each edge flange from an adjacent edge flange at the trimmed corners of the center panel.

12. The plastic tier sheet defined in claim 1, wherein the plastic sheet comprises polypropylene homopolymer.

13. The plastic tier sheet defined in claim 1, wherein the plastic sheet comprises a washable, easily sanitizable material.

14. The plastic tier sheet defined in claim 1, wherein the center panel is characteristically continuous between all of the edge flanges and characteristically does not include any holes or apertures.

15. The plastic tier sheet defined in claim 1, wherein the edge flanges and the center panel include a series of spaced-apart, sonically welded spots, which sonically welded spots are sufficiently close together to hold the edge flanges tight against the center panel, but which sonically welded spots are spaced apart to minimize the number of such sonically welded spots.

* * * * *